United States Patent [19]

Jilla

[11] 3,989,453

[45] Nov. 2, 1976

[54] MULTICOLORING POLYESTER TEXTILE MATERIALS WITH ACID DYES

[75] Inventor: Dara Ardeshir Jilla, Collinsville, Va.

[73] Assignee: Martin Processing Company, Inc., Martinsville, Va.

[22] Filed: Jan. 11, 1974

[21] Appl. No.: 432,645

[52] U.S. Cl. ..... 8/66; 8/179

[51] Int. Cl.[2] ..... D06B 21/00; C09B 27/00

[58] Field of Search ..... 8/66, 168 C, 179

[56] References Cited

UNITED STATES PATENTS

| | | | |
|---|---|---|---|
| 2,921,828 | 1/1960 | Caldwell | 8/168 C |
| 2,945,010 | 7/1960 | Caldwell et al. | 8/179 |
| 3,485,574 | 12/1969 | Miller et al. | 8/168 C |

*Primary Examiner*—M. J. Welsh

*Attorney, Agent, or Firm*—Stevens, Davis, Miller & Mosher

[57] ABSTRACT

A process is disclosed for making a multicolored polyester material dyed with acid dyes for use as the face yarn of carpets, upholstery and apparel fabrics, which comprises treating a polyester material having an affinity for acid dyes with an aqueous solution or a printing paste of (A) a condensation product of (a) formaldehyde and (b) naphthalenesulfonic acid, phenol, sulfonated phenol, diaryl sulfone, urea, melamine, or dicyandiamide; and (B) a reactive or fiber-reactive compound which contains a chromophore, preferably but not necessarily colorless, and has attached to it a reactive group, which reacts readily with a nitrogen atom of the above-mentioned modified polyester material having an affinity for acid dyes, and then exposing same to steam or dry heat at a temperature between 100° C. and 200° C. for a period of 20 seconds to 20 minutes, thereby imparting to the treated polyester material ability to "resist" acid type dyes, so that the localized regions of the polyester material pretreated with the above-mentioned impregnation-treatment will now "resist" acid dyestuffs applied later in the dyeing process whereby no coloration or coloration to a much lower depth is produced in the treated regions whereas very strong, bright and uniform coloration is produced due to acid dyes in the localized regions which were not pre-treated; thus resulting in a selective, multicoloration of the polyester material in a predetermined manner.

The resulting acid-dyed multicolored polyester material is also described and claimed.

18 Claims, No Drawings

MULTICOLORING POLYESTER TEXTILE MATERIALS WITH ACID DYES

In my copending application Ser. No. 396,805, filed Sept. 13, 1973, I describe and claim the coloring of polyester materials with acid dyes by a process that comprises impregnating the polyester material, preferably continuously, at a temperature between 90° C. and 250° C. and at ordinary atmospheric pressure, with a mixture of (a) an organic nitrogen compound and (b) a glycol, an alcohol, a ketone, an ether, or water; then flash-cooling the thus-treated polyester material with cold water or a mixture of a carboxylic acid with cold water and thereby imparting affinity for acid dyes to the treated polyester material, and then coloring the same, preferably continuously, by methods of padding, printing or cascading acid dyes from an aqueous solution or a printing paste whereby to effect fixation of said acid dyes on the polyester material with substantially uniform distribution thereof within the polyester material.

The present invention is in the nature of a species or improvement under the above general case, and concerns itself primarily with a novel process for producing multicolor effects, preferably but not necessarily continuously, on polyester textile materials such as multifilament continuous filament or staple fiber yarn for use as the face yarn of carpets, upholstery and apparel fabrics, including pile fabrics.

Polyester materials are mainly dyed with disperse and azoic dye combinations and certain vat dyes, as more fully described on pages 21–267 of the book entitled "The Dyeing of Polyester Fibers", Third Edition, Imperial Chemical Industries Limited, November 1964, published by Raithby, Lawrence and Company, Great Britain. Also, modified polyesters are dyeable with basic type dyes, as more fully described and claimed in the Griffing et al U.S. Pat. No. 3,018,272. However, mere staining of polyesters is obtained with other well known classes of dyes, such as direct, reactive, acid, chrome and sulphur dyes. These stains are almost always restricted to surface coloration, and in any event possess poor fastness properties. Space or random dyeing is a well-established technique used to multicolor a variety of yarns used in the home furnishings and apparel fields, as more fully described on pages 45 and 53 of Modern Textiles, Vol. LIV, No. 3, March 1973.

The present invention is based upon a complete departure in concept from all previous attempts at producing the desired multicolored textile materials, and consequently it is free from the various difficulties and shortcomings of the prior art mentioned above.

Accordingly, it is an object of this invention to provide a process for producing multicolor effects with acid dyes on polyester textile materials, preferably but not necessarily continuously. It is a further object of this invention to provide multicolored polyester material (such as yarn) dyed with acid dyes and to use the yarn as the face yarn of a carpet, upholstery or apparel fabric, a pattern being produced on the face of the finished fabric which has a more attractive and novel random distribution of colors over the face of the fabric. Additional important objects of this invention will appear as the description proceeds.

These objects are achieved according to this invention by subjecting the polyester material (previously modified to possess the affinity for acid type dyes as described and claimed in my above-identified copending application Ser. No. 396,805) to a special impregnation-treatment with an aqueous solution or printing paste of (A) condensation products of (a) formaldehyde and (b) naphthalenesulfonic acid, phenol, sulfonated phenol, diaryl sulfone, urea, melamine, or dicyandiamide; and (B) reactive (or fiber-reactive) compounds which contain a chromophore, preferably but not necessarily colorless, and having attached thereto a reactive group (which reacts readily with a nitrogen atom of the above-mentioned modified polyester material having an affinity for acid dyes), on a continuous roll by such per se well known methods as padding, printing or cascading following by per se known methods of fixation by steam or dry heat, rinsing with clear water and then drying. The special impregnation-treatment may desirably be carried out at ambient temperature, but higher temperatures (e.g., up to about 80° C.) are permissible.

Generally, steaming for 1–20 minutes at 100° C. is sufficient for full fixation. Dry heat fixation, normally for 20–80 seconds at 100° – 200° C., is also satisfactory although giving somewhat inferior results in comparison to those obtained by steam fixation.

Suitable portions (in the direction of yarn travel) of the polyester material (such as yarn) may be intermittently subjected to the above-mentioned impregnation-treatment. This selective impregnation of the polyester material may be varied in a precise and controlled manner according to any predetermined pattern by means per se well known in the art.

I have discovered that this treatment of pre-treatment in some manner modifies the affinity of the said polyester material for acid dyes. The portions of the polyester material that have been pre-treated by the above-mentioned impregnation-treatment will now "resist" acid dyestuffs applied later in the dyeing process. Acid dyes leave the treated portions of the polyester material undyed or dyed to a lower depth than the untreated portions. The degree of resist, reservation of differentiation (affinity for acid dyes) is controlled by the concentration of the active ingredients in the impregnation-treatment, the constitution of the acid dye chosen for the subsequent dyeing process, and the nature of the subsequent dyeing processes. Consequently, a wide variety of interesting effects can be obtained —e.g., from a pronounced differentiation up to full resist (clear white effects), or medium (half-tone effects) or low differentiation with sharply defined edges.

The thus-treated polyester material is then subsequently over-dyed with an aqueous solution or printing paste of acid dyes in such per se well known devices as winches, jigs, paddle, dyebeck and beam dyeing machines, or continuous dyeing ranges currently in use. No or substantially no coloration is thereby produced in those localized regions of the polyester material that were impregnated by the above-mentioned impregnation-treatment whereas very strong, bright and uniform coloration is produced due to the acid dyes in those localized regions which were not impregnated by the above-mentioned impregnation-treatment. The result is selective coloration of the polyester material with acid dyes in a predetermined manner to produce a very pleasing pattern in the final yarn. Any desired pattern contour may be obtained in this way, whether random or repetitive. Thus, the process of my present invention produces novel, multicolor effects of distinctive character.

A major advantage gained by pre-treating polyester materials according to my present invention is that patterned goods can be dyed (with the appropriate choice of the dyeing process and the shade) as the final step of the processing sequence, regardless of whether the polyester material is in the form of woven fabrics, knitwears or carpets, which makes for flexibility, simplifies stock control (since no dyed yarns or carpeting have to be inventoried), and reduces delivery time for the textile mill.

As the above-mentioned (A) condensation products of formaldehyde and naphthalenesulfonic acid, phenol, sulfonated phenol, diaryl sulfone, urea, melamine or dicyandiamide, there may be mentioned, for example, mixed condensates of naphthalene monosulfonic acids with dihydroxy diphenylsufones and formaldehyde, phenol sulfonic acid products, sodium sulfonic acid products, etc.

As the above-mentioned (B) reactive (or fiber-reactive) compounds, there may be mentioned, for example, those based upon functional groups such as mono- or dichlorotriazine; mono- or dichlorotriazinyl; vinylsulphonyl; trichloropyrimidinyl; dichloropyridazonyl; dichlorophthalazine carbonyl; chloroquinoxaline; acryloylamido; chlorobenzothiazolsulphonyl; etc., and desired types of chromophores which are pale yellow, blue or colorless, as more fully described on pages 81–204 of "Fiber-Reactive Dyes", by W. F. Beech, London, 1970.

Other methods of applying the principles of this invention may be employed instead of those specifically mentioned inasmuch as it will be apparent that obvious modifications thereof may be made within the skill of the art without departing from the spirit of the invention and the scope of the appended claims. Without limiting my invention, therefore, the following examples are given in order still better to illustrate the details of operation. These examples include actual runs made in the laboratory to test the chemical validity of the process. Because of the laboratory scale of the test, the experiments were done on a relatively limited quantity of polyester film, yarn and fabric using a batch process. The convertibility of the process in each instance into continuous operation on a plant scale (using conventional apparatus appropriate for continuous plant scale operation) is perfectly obvious from the short period of time required for the pre-treatment of the said polyester material to modify the affinity thereof for acid dyes.

EXAMPLE 1

A paste containing the following was prepared:

| | |
|---|---|
| Formaldehyde-added naphthalene monosulfonic acid, dihydroxy diphenylsulfone mixture | 10 cc. |
| Benzyl alcohol (commercial) | 6 cc. |
| Sulfuric acid (concentrated) | 0.05 cc. |
| "Lyogen" V(U) (a commercial wetting agent) | 0.05 cc. |
| "Kelzan" (a commercial thickener or printing gum) | 1.0 gram |
| Water | 233.9 cc. |

Selected portions of the polyethylene terephthalate staple fiber yarn (modified to possess affinity for acid type dyes as described and claimed in my above-identified copending application Ser. No. 396,805) about 10 inches long in the direction of yarn travel were printed at ambient temperature with this paste, steamed at 100° C. for 5 minutes, rinsed and then dried. This pre-treatment imparted the desired "resist" (to acid dyes) property to the treated polyester material.

1 gram of "Merpacyl" Blue SW (C.I. Acid Blue 25), an acid dye of the anthraquinone type, 200 cc. of water and 0.2 cc. of concentrated sulfuric acid were stirred together at 99° C. until the dye was completely dissolved. The polyethylene terephthalate yarn, pretreated as just described, was impregnated with the above acid dye solution at 99° C. for 30 seconds, steamed at 100° C. for 3 minutes for color fixation, rinsed and then dried. An extremely beautiful multicolor effect was obtained. A very low depth of blue shade was obtained in those localized regions of the yarn which had been printed with the above-mentioned printing paste; in contrast, a deep, bright blue shade was produced in those localized regions of the yarn which were not printed with the above-mentioned printing paste.

In this manner a definite and predetermined pattern was obtained in the final yarn with bright blue colored localized regions along the direction of yarn travel followed by adjacent localized regions with very little coloration, and this is repetitive. An extremely beautiful multicolor effect was obtained in this manner.

EXAMPLE 2

A paste containing the following was prepared:

| | |
|---|---|
| Formaldehyde-added phenol sulfonic acid mixture | 25 cc. |
| Benzyl alcohol (commercial) | 6 cc. |
| Sulfuric acid (concentrated) | 0.05 cc. |
| "Lyogen" V(U) (a commercial wetting agent) | 0.05 cc. |
| "Kelzan" (a commercial thickener or printing gum) | 1.0 gram |
| Water | 218.9 cc. |

A motif representing the Star of David was printed at ambient temperature with this paste on both sides of a polyethylene terephthalate film, 2.0 mil in thickness (modified to possess affinity for acid type dyes as described and claimed in my above-identified copending application Ser. No. 396,805). The film was then passed continuously through a flue drier at 150° C., the rate of feed being regulated to give an exposure time of 20 seconds. The film was then rinsed and dried.

A dye solution containing 1 gram of "Merpacyl" Red B (C.I. Acid Red 266), an acid dye of the azo type, 200 cc. of water and 0.2 cc. of concentrated sulfuric acid was prepared as in Example 1. The polyethylene terephthalate film, pre-treated as just described, was then treated with the above dye solution at 99° C. for 60 seconds, rinsed and dried. The film is dyed a very bright shade of red; however, the acid dye left the motif (which was printed with the above-mentioned paste) undyed. Thus, a motif representing the Star of David with sharply defined edges was obtained on the film.

EXAMPLE 3

A paste containing the following was prepared:

| | |
|---|---|
| "Procion" Brilliant Blue M.R.* (C.I. Reactive Blue 4) | 1.0 gram |
| Formaldehyde-added phenol sulfonic acid mixture | 10.0 cc. |
| Benzyl alcohol (commercial) | 6 cc. |
| Sulfuric acid (concentrated) | 0.05 cc. |

-continued

| | |
|---|---|
| "Lyogen" V(U) (a commercial wetting agent) | 0.05 cc. |
| "Kelzan" (a commercial thickener or printing gum) | 1.0 gram |
| Water | 233.9 cc. |

*For the structural formula of this dye, see W. F. Beech, loc. cit., p. 126.

Selected portions of a polyethylene terephthalate staple fiber yarn (modified to possess affinity for acid type dyes as described and claimed in my above-identified copending application Ser. No. 396,805) about 10 inches long in the direction of yarn travel were printed at ambient temperature with this paste, steamed at 100° C. for 5 minutes, rinsed and then dried. This pre-treatment imparted the desired "resist" (to acid dyes) property to the treated polyester material and also imparted blue coloration to the treated localized portions.

A dye solution containing 1 gram of "Levalan" Red 3B (C.I. Acid Red 80), an acid dye of the anthraquinone type, 200 cc. of water and 0.2 cc. of concentrated sulfuric acid was prepared as in Example 1. The polyethylene terephthalate staple fiber yarn, pre-treated as just described, was impregnated with the above dye solution at 99° C. for 30 seconds, steamed at 100° C. for 3 minutes for color fixation, rinsed and dried. An extremely beautiful multicolor effect was obtained. A very low depth of red shade was obtained in those localized regions of the yarn which had been printed with the above-mentioned printing paste; in contrast, a deep, red shade was obtained in those localized regions of the yarn which was not printed with the above-mentioned paste. In this manner, a multicolor effect was obtained showing different colors, some red and some blue.

It will be clear from the above examples that my present invention is applicable to a wide variety of polyester materials modified to possess the affinity for acid dyes as described and claimed in my above-identified copending application Ser. No. 396,805. Multifilament, continuous filament or staple fiber yarns and woven or knitted fabrics, and films are the preferred structures for treatment in accordance with the present invention. These polyester materials when treated according to my present invention "resist" acid dyes, so that on subsequent over-dyeing with an aqueous dyebath of acid dyes either no coloration or coloration to a much lower depth is obtained, depending on the concentration or intensity of the impregnation applied; whereas very bright, strong and deep coloration is produced with acid dyes in the localized regions of the polyester material which were not pre-treated. Thus, commercially important multicoloration effects are obtained that are eminently suitable for the usual textile applications. The multicolor effect can be controlled in a predetermined manner to produce a desired pattern in the final fabric. Any desired pattern contour on the face of the finished fabric can be obtained in this way. A complete range of hues can be obtained, many of them being very bright. These polyester materials may be employed in the knitting, weaving, flocking or tufting of carpets, upholstery or apparel fabrics, including pile fabrics.

By an "acid dye" is meant a colored anionic organic substance such as those containing azo, anthraquinone, quinoline, triphenylmethane, azine, xanthene, ketonimine, nitro or nitroso compounds. Among the acid dyes which may be applied to the polyester materials in accordance with the present invention may be mentioned Merpacyl Blue SW (C.I. 25); Merpacyl Blue 2GA (C.I. 40); Telon Fast Yellow EF (C.I. 103); Nylomine Acid Green C-3G (C.I. 40); Levalan Red 3B (C.I. 80); Chinoline Yellow 0 (C.I. 3); and the like.

The subsequent over-dyeing of the pre-treated polyester material with aqueous solutions of acid dyes is carried out with the aid of such per se well-known devices as winches, jigs, paddle, dye-beck and beam dyeing machines, or continuous dyeing ranges.

If desired, the aqueous dye solutions may be rendered strongly acidic the conventional manner such as by the addition of an appropriate amount of an acid such as sulfuric acid or formic acid. Other dyebath additives, such as thickeners, foaming agents, wetting agents, levelling agents, retarders or buffers may also be present.

When reference is made in the subjoined claims to an acid dye, it will be understood that mixtures of different acid dyes are contemplated as being within the invention.

The polyester materials mentioned above by way of example are the polyester materials modified to possess the affinity for acid type dyes as described and claimed in my above-identified copending application Ser. No. 396,805.

I do not wish to be limited to the treatment of any particular kind of polyester materials, especially since polyester materials are old and well-known and per se form no part of the present invention. Consequently, I consider it sufficient for background disclosure purposes to refer broadly to the following literature source for further information on these per se old materials: Mark-Gaylord's Encyclopedia of Polymer Technology, Vol. 11, 1969, pages 1–128. The polyethylene terephthalate specifically mentioned above by way of example is of course a well-known kind of commercially available polyester material.

What is claimed is:

1. A process of making a multicolored polyester material dyed with acid dyes for use as the face yarn of carpets, upholstery of apparel fabric, which comprises taking a polyester material that has first been pretreated with a mixture of (1) an organic nitrogen compound and (2) a glycol, an alcohol, a ketone, an ether, or water to impart thereto an affinity for acid dyes, contacting the said pretreated polyester material with an aqueous solution or a printing paste of (A) a condensation product of (a) formaldehyde and (b) naphthalene-sulfonic acid, phenol, sulfonated phenol, diaryl sulfone, urea, melamine, or dicyandiamide; and (B) a fiber-reactive compound which contains a chromophore, and has attached to it a reactive group which reacts readily with a nitrogen atom of the above-mentioned pretreated polyester material having an affinity for acid dyes, and then exposing same to steam or dry heat at a temperature between 100° C and 200° C for a period of 20 seconds to 20 minutes, thereby imparting to the treated polyester material ability to "resist" acid type dyes, and thereafter over-dyeing the thus-treated polyester material with acid dyes.

2. A process as defined in claim 1, wherein the impregnation-treatment bath with which the polyester material is pretreated is a fiber-reactive compound which contains a chromophore having attached to it a reactive group selected from the class consisting of mono- or dichlorotriazine; mono- or dichlorotriazinyl; vinylsulphonyl; trichloropyrimidinyl; dichloropyridazonly; dichlorophthalazine carbonyl; chloroquinoxaline; acryloylamido; and chlorobenzothiazolsulphonyl.

3. A process as defined in claim 1, wherein the textile material undergoing treatment is in the form of a bundle of continuous filament multi-filament yarn.

4. A process as defined in claim 1, wherein the textile material undergoing treatment is in the form of a bundle of staple fiber yarn.

5. A process of making a house furnishing fabric, which comprises producing a multicolored polyester finished face yarn by the process as defined in claim 1 so that different lengths of the yarn will have different colors, and forming a fabric of the finished face yarn having the yarn and its colors exposed at the face of said fabric.

6. A process as defined in claim 5, in which the finished face yarn is continuous filament multi-filament yarn.

7. A process as defined in claim 5, in which the finished face yarn is staple fiber yarn.

8. A process of making a house furnishing fabric, which comprises producing a multicolored, polyester finished face yarn by the process as defined in claim 1 so that different lengths of the yarn will have different colors, and forming a pile on a backing by tufting said finished face yarn through said backing, and exposing said yarn at the pile face.

9. A process as defined in claim 8, in which the color on the finished face yarn is in short section along the length of the yarn and simulates a nub effect in the pile.

10. A process as defined in claim 8, in which the pile face of the fabric produced includes uncut loops of said finished face yarn.

11. A process as defined in claim 8, in which the finished face yarn is continuous filament multi-filament yarn.

12. A process as defined in claim 8, in which the finished face yarn is staple fiber yarn.

13. A process as defined in claim 1, in which the said contacting step is carried out at temperatures ranging from ambient up to 80° C.

14. A process as defined in claim 1, wherein suitable localized regions of polyester material are contacted in a precise controlled manner with the said impregnation-treatment bath according to a predetermined pattern whereas other localized regions of the said polyester material are not contacted with the said impregnation-treatment bath; thus resulting in a selective multicoloration of the said polyester material with no coloration or coloration to a much lower depth produced due to acid dyes applied later in the dyeing process in the above-mentioned localized regions of the said polyester material which were contacted with the said impregnation-treatment bath whereas very strong, bright and uniform coloration will be produced due to acid dyes applied later in the dyeing process in the above-mentioned localized regions of the said polyester material which were not contacted with the said impregnation-treatment bath.

15. An acid-dyed multicolored polyester material produced by the process of claim 1.

16. The polyester material of claim 15, wherein the polyester material is in the form of a film, fiber or filament.

17. The polyester material of claim 15, wherein the polyester material is in the form of a multi-filament continuous filament or staple fiber yarn.

18. The polyester material of claim 15, wherein the polyester material is of woven, non-woven, knitted, tufted, needle-punched, flocked or laminated structure.

* * * * *

Disclaimer and Dedication 3,989,453.—*Dara Ardeshir Jilla*, Collinsville, Va. MULTICOLORING POLYESTER TEXTILE MATERIALS WITH ACID DYES. Patent dated Nov. 2, 1976. Disclaimer and dedication filed June 24, 1980, by the assignee, *Martin Processing Company, Incorporated.*

Hereby disclaims and dedicates to the Public the entire remaining term of said patent.

[*Official Gazette September 16, 1980.*]